US005911653A

United States Patent [19]

Cheng

[11] Patent Number: 5,911,653

[45] Date of Patent: Jun. 15, 1999

[54] FOLDABLE-PLAYPEN

[76] Inventor: Ching-Wen Cheng, 5th Fl., No. 100, Wenlin N. Rd., Peitou Dist., Taipei, Taiwan

[21] Appl. No.: 08/994,192

[22] Filed: Dec. 19, 1997

[51] Int. Cl.[6] ..... A47C 9/00

[52] U.S. Cl. ..... 5/99.1; 5/93.1; 5/98.2

[58] Field of Search ..... 5/99.1, 93.1, 174, 5/98.2, 102, 425, 424, 236.1

[56] References Cited

U.S. PATENT DOCUMENTS

| | | | |
|---|---|---|---|
| 2,164,484 | 7/1939 | Wolfe | 5/425 |
| 2,590,129 | 3/1952 | Sawaya | 5/174 |
| 2,620,490 | 12/1952 | Bruce | 5/425 |
| 3,967,331 | 7/1976 | Glassman | 5/236.1 |
| 5,384,925 | 1/1995 | Vail | 5/424 |
| 5,530,977 | 7/1996 | Wang | 5/99.1 |
| 5,699,997 | 12/1997 | Huang | 5/99.1 |
| 5,730,542 | 3/1998 | Cheng | 5/99.1 |
| 5,752,283 | 5/1998 | Arens | 5/99.1 |

*Primary Examiner*—Michael F. Trettel
*Assistant Examiner*—Fredrick Conley
*Attorney, Agent, or Firm*—Bacon & Thomas, PLLC

[57] ABSTRACT

The present invention relates to a foldable playpen which comprises a main frame constructed of top articulated bars and upright bars, which is provided with a covering to form an enclosure so that a baby can be left to play therewithin. The primary feature of the present invention resides in that the main frame includes a bottom sub-frame structure pivotably mounted at the bottom of the main frame. The bottom sub-frame structure includes at least first, second, third and fourth bottom side-bars, and a folding mechanism. The first, second, third and fourth bottom side-bars are arranged in a pivotingly foldable relationship with the folding mechanism, whereby the present invention can be conveniently folded into a compact package when it is not in use or extended to an erect enclosure for allowing a baby to play therewithin.

6 Claims, 11 Drawing Sheets

FOLDABLE-PLAYPEN

BACKGROUND OF THE INVENTION

The present invention relates to a foldable playpen, and more particularly to a foldable playpen which includes a bottom sub-frame structure pivotably mounted at the bottom thereof, by which the structural frame of the playpen can be conveniently folded into a compact mode when it is not in use or extended to an erect mode for allowing a baby to play therewithin.

BRIEF SUMMARY OF THE INVENTION

In accordance with one aspect of the present invention, a typical embodiment of a foldable playpen comprises a main frame constructed of top articulated bars and upright bars. The main frame is provided with a covering to form an enclosure within which a baby can be left to play. The main frame includes a bottom sub-frame structure which includes at least first, second, third and fourth bottom side-bars, and a folding mechanism. The first bottom side-bar is disposed in alignment with the second bottom side-bar. The third bottom side-bar is disposed in alignment with the fourth bottom side-bar. Each of the first, second, third and fourth bottom side-bars has one end to be pivotably connected with one of the upright bars of the main frame respectively. Each of the first bottom side-bar and the second bottom side-bar has another end to be controllably pivotably connected with a first auxiliary coupling holder so that the first bottom side-bar can be coupled with the second bottom side-bar to be as an integral straight section of bar. Each of the third bottom side-bar and fourth bottom side-bar has another end to be controlling pivotably connected with a second auxiliary coupling holder so that the third bottom side-bar can be coupled with the fourth bottom side-bar to be as an integral straight section of bar. The folding mechanism including a folding head located substantially at the center of the bottom sub-frame structure of the main frame, and a plurality of diagonal bars which are arranged to surround the folding head to be each pivotably connected with the folding head at one end thereof and to be each pivotably connected with one of the first, second, third and fourth bottom side-bars at another end thereof by means of a hinge member. The hinge member has a sleeve portion which is movably and rotatably mounted with a corresponding one of the first, second, third and fourth bottom side-bars so that the diagonal bars can be rotated and moved with respect to each bottom side-bar associated therewith to allow the diagonal bars to be pivoted with respect to the folding head, in cooperation with a folding of the first, second, third and fourth bottom side-bars together with a folding of the top articulated bars, so as to fold the present invention.

Other novel aspects and advantages of the invention will become more apparent from the following detailed description when taken in conjunction with the accompanying drawings.

DETAIL DESCRIPTION OF THE PREFERRED EMBODIMENT

Figure 1:
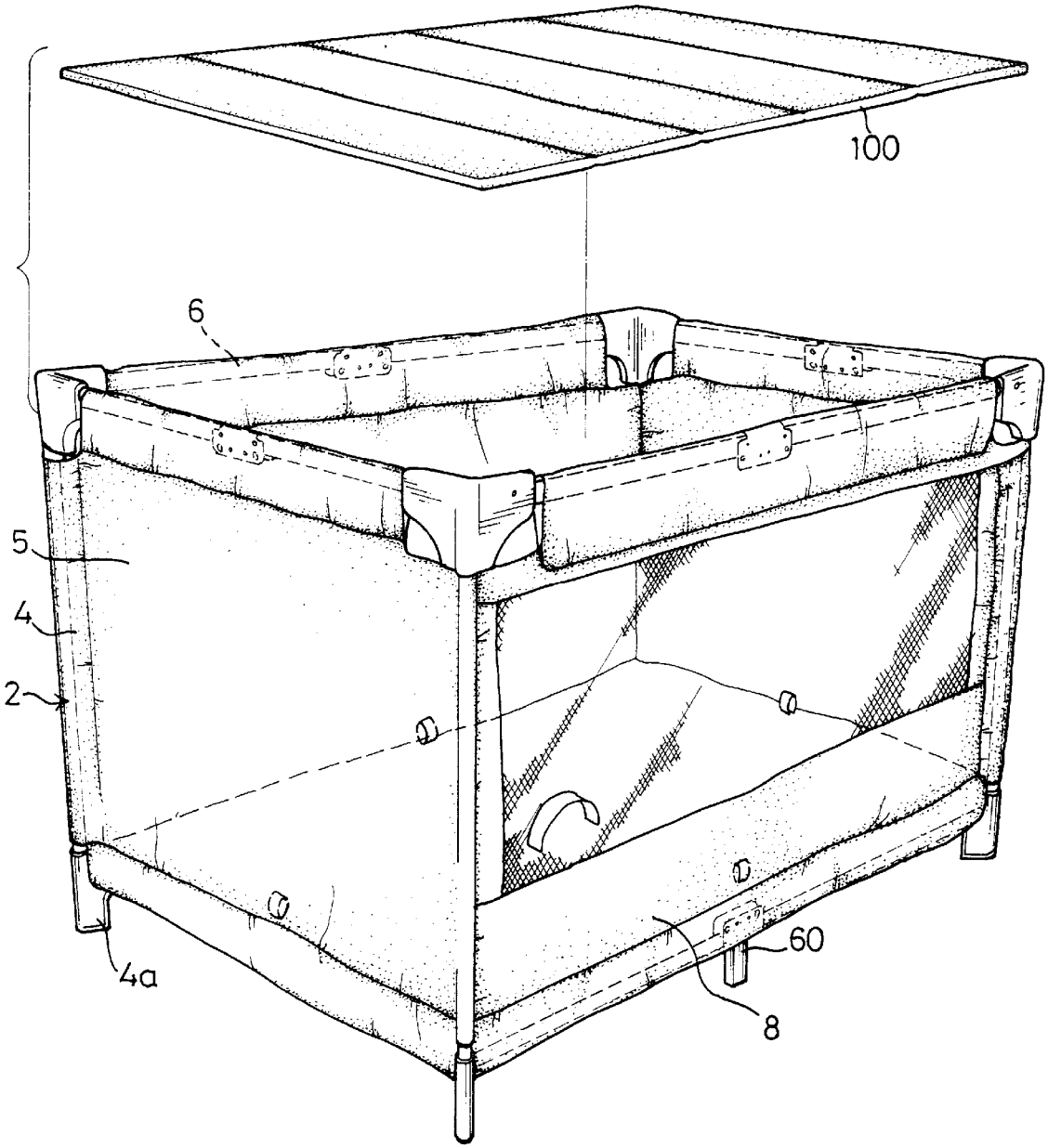
FIG. 1 is a perspective view of a typical embodiment in accordance with the present invention.
Figure 14:
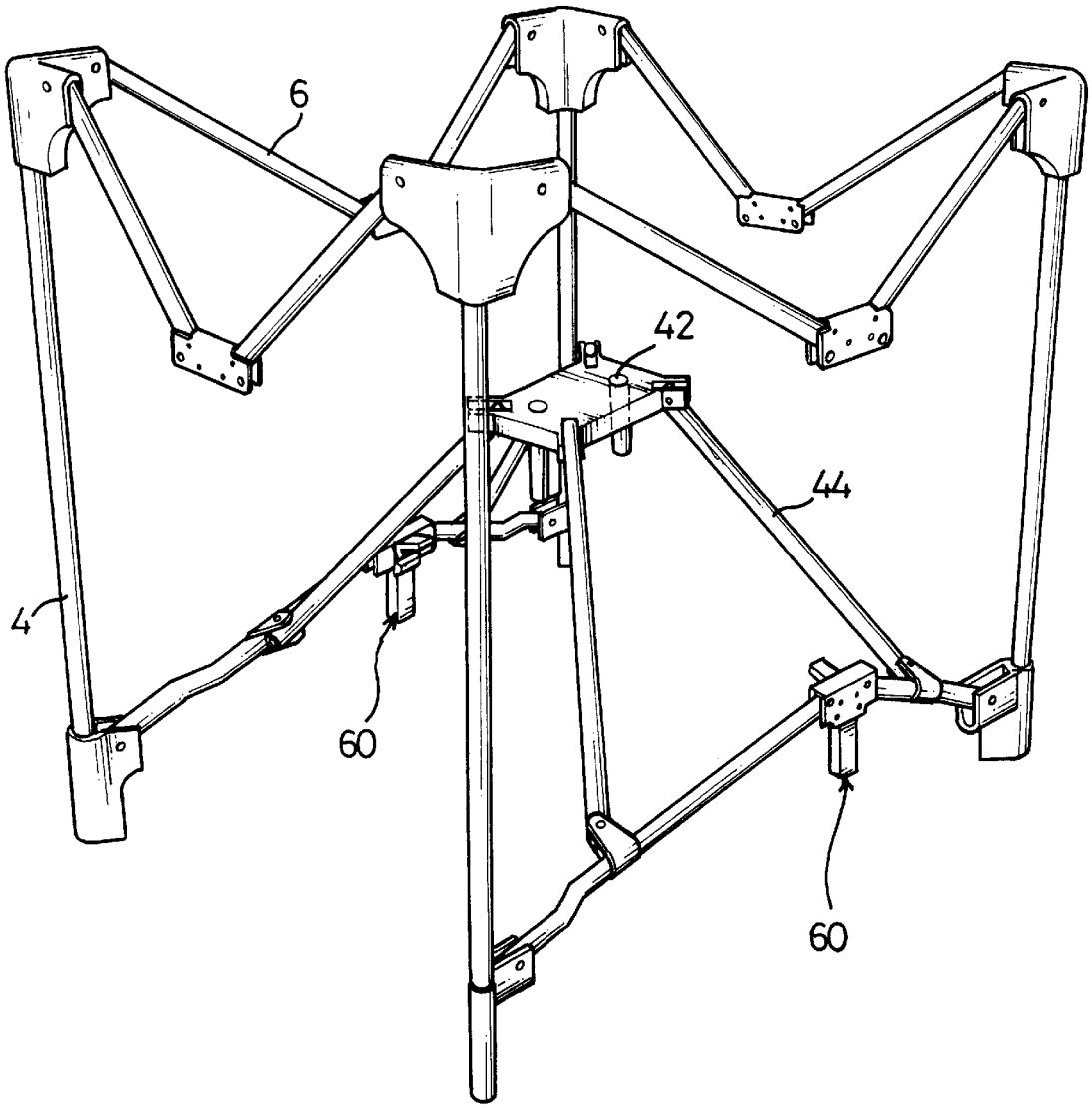
FIG. 14 shows a perspective view of a semi-folded frame with regard to the embodiment of FIG. 1, where the covering of the frame is not shown.

Referring to FIG. 1, an embodiment of a foldable playpen in accordance with the present invention is disclosed. The embodiment is constructed of a main frame 2 which is provided with a covering 5, such as a mesh net, to form an enclosure within which a baby can be left to play, as can be commonly seen in the prior art. The main frame 2 generally includes four upright bars 4 each with a foot support 4*a*, and four top articulated bars 6 each being pivotably connected between a respective two of the four upright bars 4. In particular, the primary feature of the present invention resides in that the main frame 2 is provided with a bottom sub-frame structure 8 (see FIG. 2) which allows the present invention to be folded into a compact package (see FIG. 14), as will be fully described below.

Figure 2:
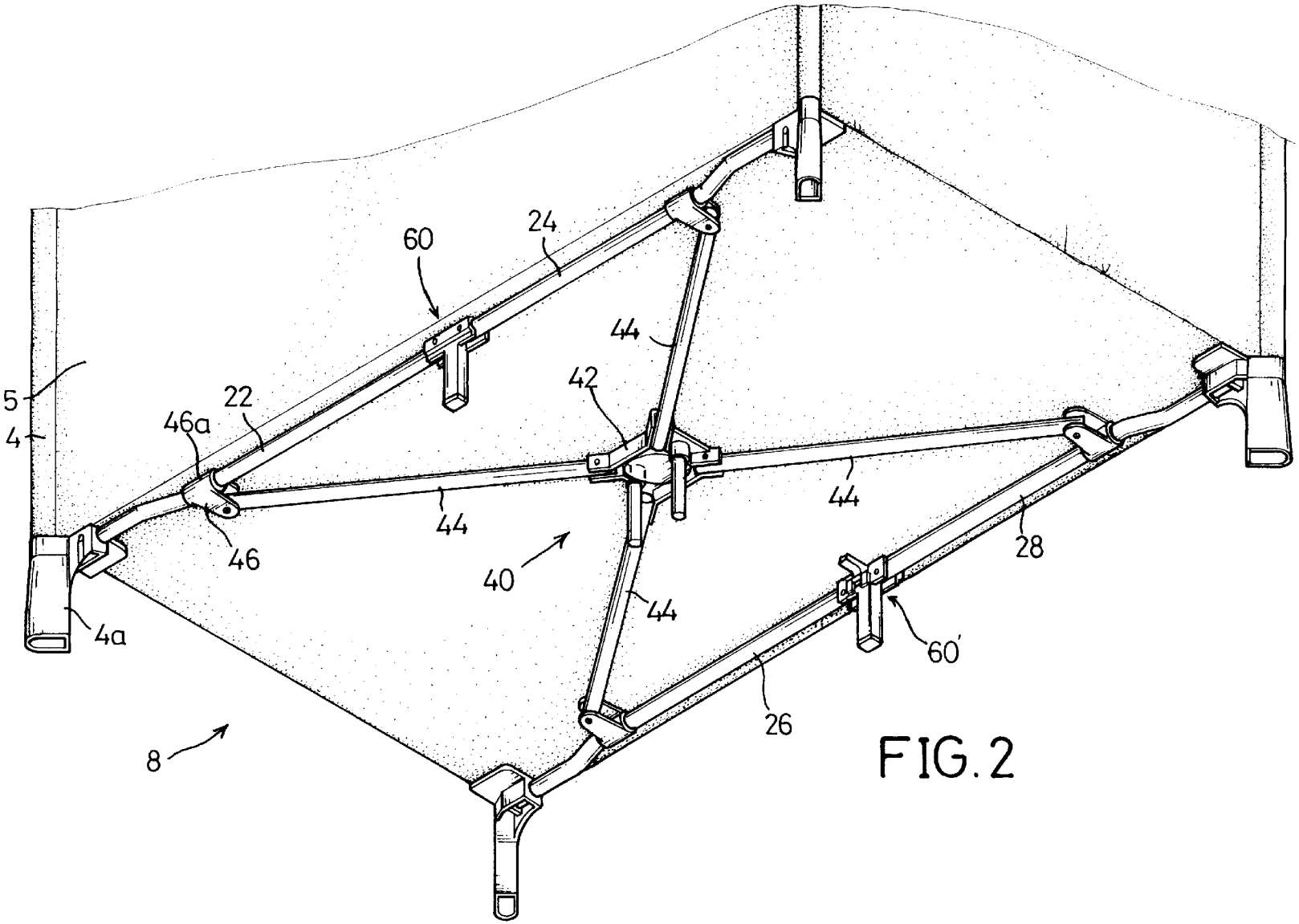
FIG. 2 is a perspective view of the embodiment seen from the bottom thereof.
Figure 3:
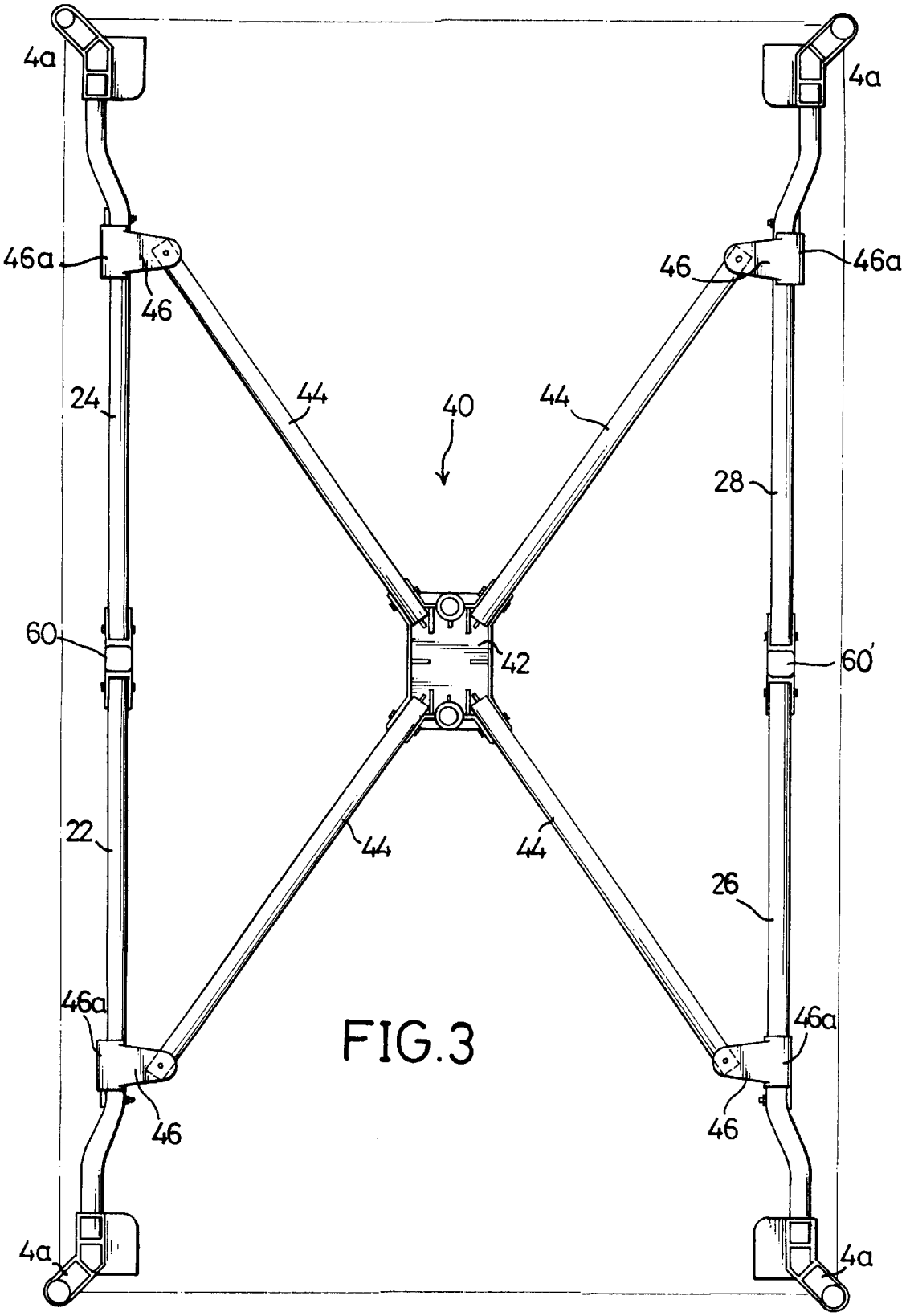
FIG. 3 is a bottom plan view of the embodiment.
Figure 4:
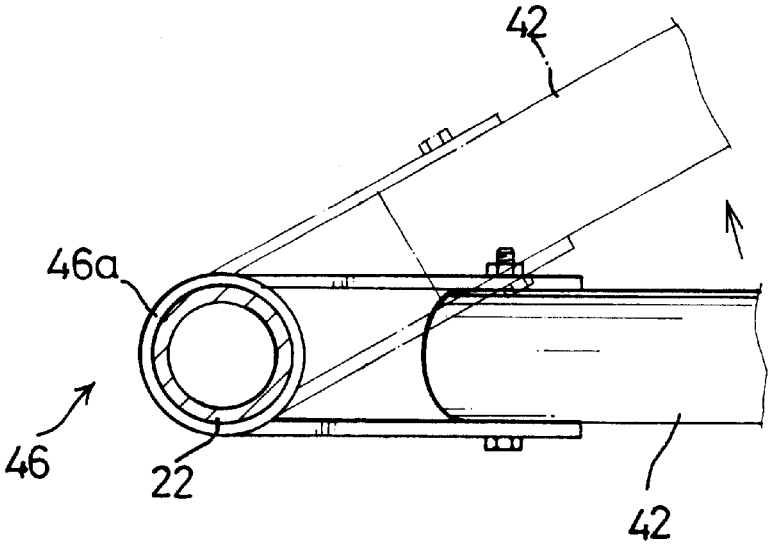
FIG. 4 is an enlarged cross-sectional view of a hinge member disclosed in the present invention.
Figure 5:
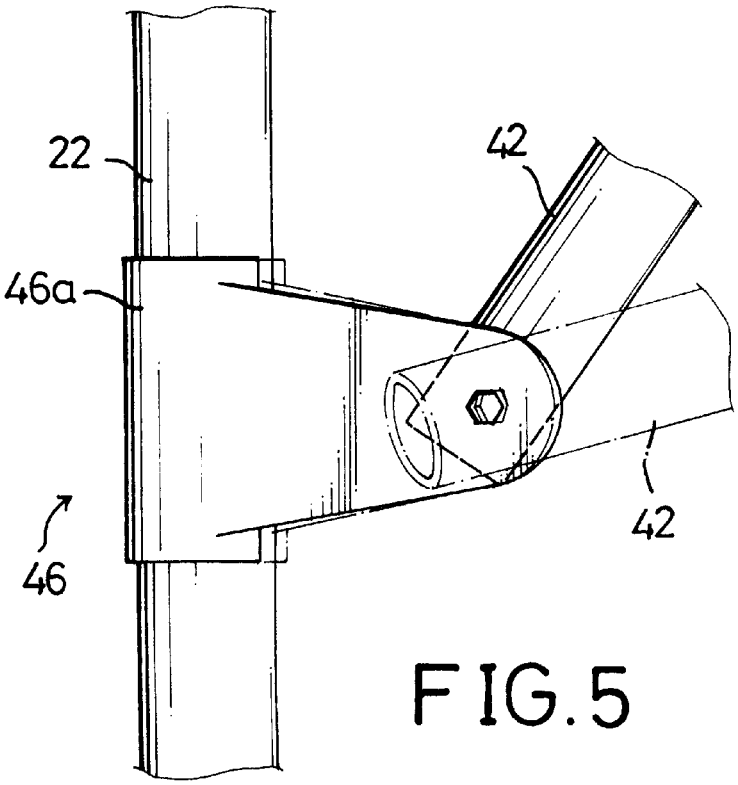
FIG. 5 is an enlarged side view of the hinge member disclosed in the present invention.

Please refer to FIG. 2, which is a perspective view seen from the bottom of the present invention, the bottom sub-frame structure 8 includes at least a first bottom side-bar 22, a second bottom side-bar 24, a third bottom side-bar 26, a fourth bottom side-bar 28, and a folding mechanism 40. The first bottom side-bar 22 is disposed in alignment with the second bottom side-bar 24; the third bottom side-bar 26 is disposed in alignment with the fourth bottom side-bar 28. Each of the first bottom side-bar 22, the second bottom side-bar 24, the third bottom side-bar 26, and the fourth bottom side-bar has one end to be pivotably connected with one of the four upright bars 4. Each of the first and second bottom side-bars 22, 24 has another end to be controllably and pivotably connected with a first auxiliary coupling holder 60 so that the first bottom side-bar 22 can be coupled with the second bottom side-bar 24 to be as an integral straight section of bar, as will be fully described below. Each of the third and fourth bottom side-bars 26, 28 has another end to be controllably and pivotably connected with a second auxiliary coupling holder 60' so that the third bottom side-bar 26 can be coupled with the fourth bottom side-bar 28, as will be fully described below.

The folding mechanism 40 includes a folding head 42 and a plurality of diagonal bars 44. The folding head 42 is located substantially at the center of the bottom sub-frame structure 8. The diagonal bars 44 are arranged to surround the folding head 42 to be each pivotably connected with the folding head 42 at one end thereof, and to be each pivotably connected with one of the four bottom side-bars 22, 24, 26, 28 at another end thereof, by means of a hinge member 46. As shown in FIGS. 2–5, the hinge member 46 has a sleeve portion 46*a*, which is movably and rotatably mounted with a corresponding one of the first, second, third and fourth bottom side-bars 22, 24, 26, 28, so that each of the diagonal bars 44 can be rotated and moved with respect to each bottom side-bar associated therewith to allow the diagonal bars 44 to be pivoted with respect to said folding head 42, in cooperation with a folding of the bottom side-bars 22, 24, 26, 28 together with a folding of the top articulated bars 6, so as to fold the present invention as will be fully described below.

Referring back to FIGS. 2 and 3, the first auxiliarity coupling holder 60 is disposed between the first bottom side-bar 22 and the second bottom side-bar 24 to be controllably pivotably connected with the first bottom side-bar 22 and the second bottom side bar 24 so that the first bottom side-bar 22 and the second bottom side-bar 24 can be coupled to be as an integral straight section of bar by turning the first bottom side-bar 22 and the second bottom side-bar 24 outwards from each other, or the first bottom side-bar 22 and the second bottom side-bar 24 can be folded by turning the first bottom side-bar 22 and the second bottom side-bar 24 towards each other. The second auxiliarity coupling holder 60' is disposed between the third bottom side-bar 26 and the fourth bottom side-bar 28 to be controllably and pivotably connect bottom side-bar 28, so that the third bottom side-bar 26 and the fourth bottom side-bar 28 can be coupled to be as an integral straight section of bar by turning the third bottom side-bar 26 and the fourth bottom side-bar 28 outwards from each other, or the third bottom side-bar 26 and the fourth bottom side-bar 28 can be folded by turning the third bottom side-bar 26 and the fourth bottom side-bar 28 towards each other.

Figure 6:
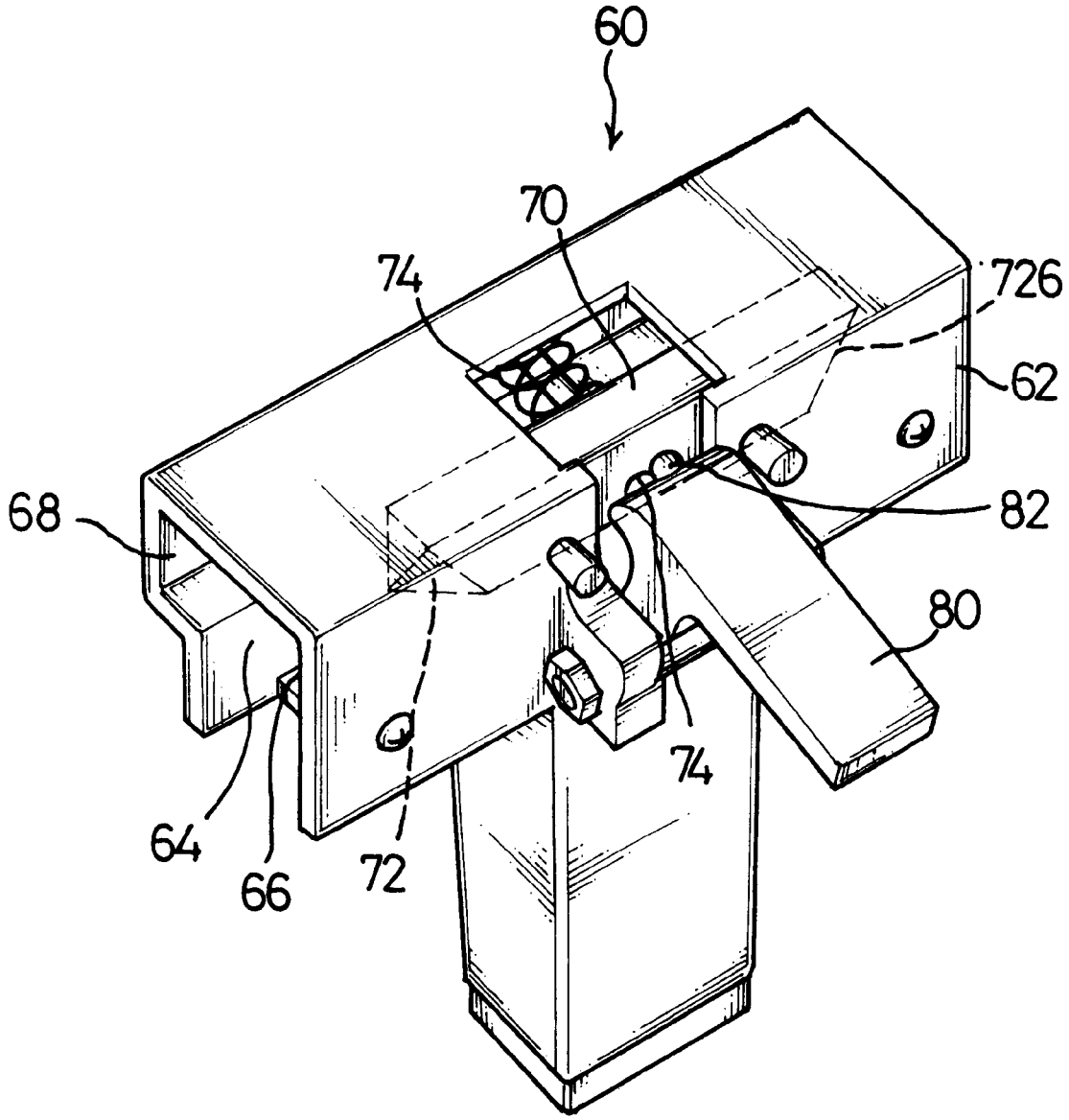
FIG. 6 is a perspective view of an auxiliary coupling holder disclosed in the present invention.
Figure 7:
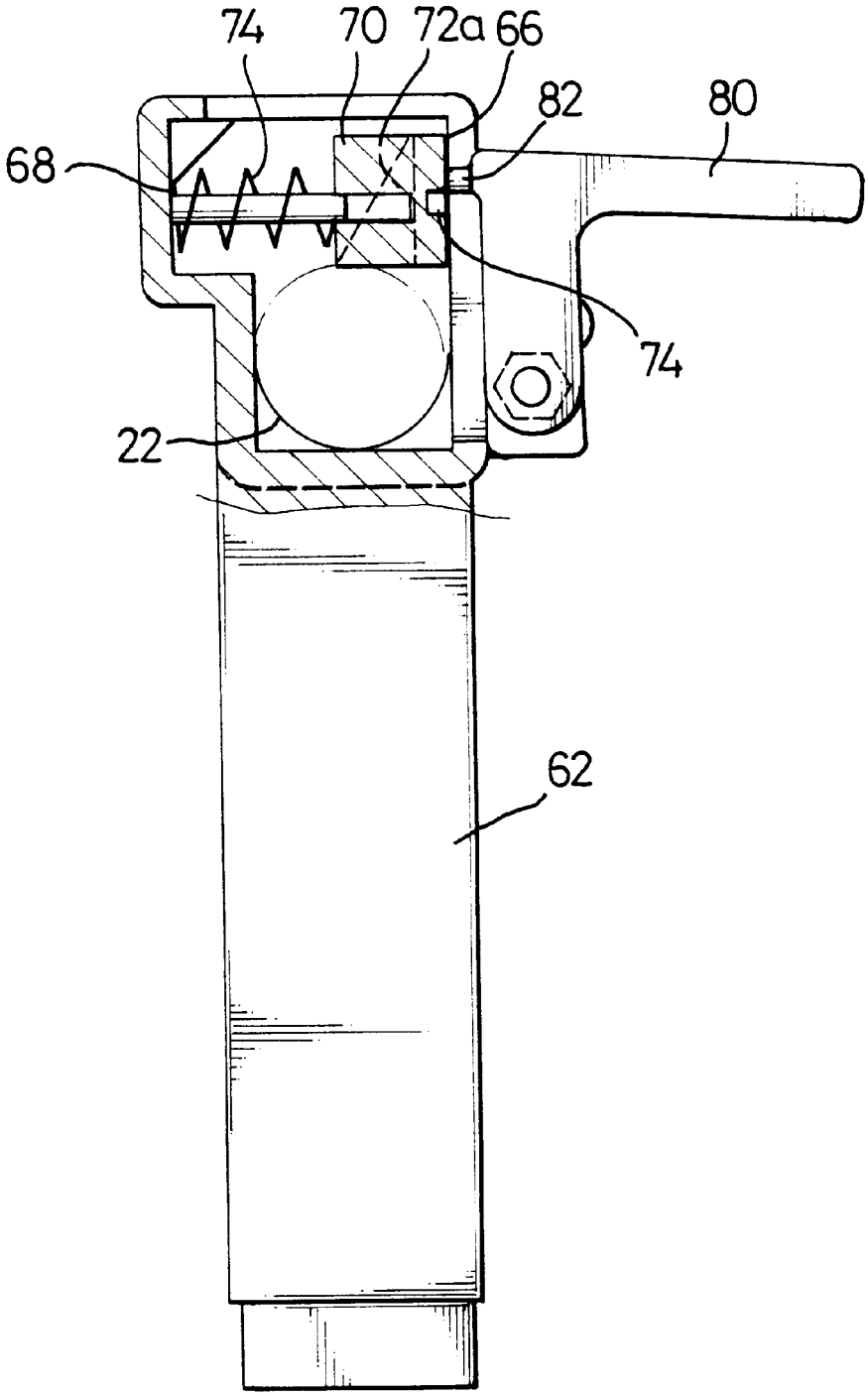
FIG. 7 shows a side view of the auxiliary coupling holder, which is under such a second condition that a bottom side-bar of the present invention cannot be pivoted with respect thereto.
Figure 8:
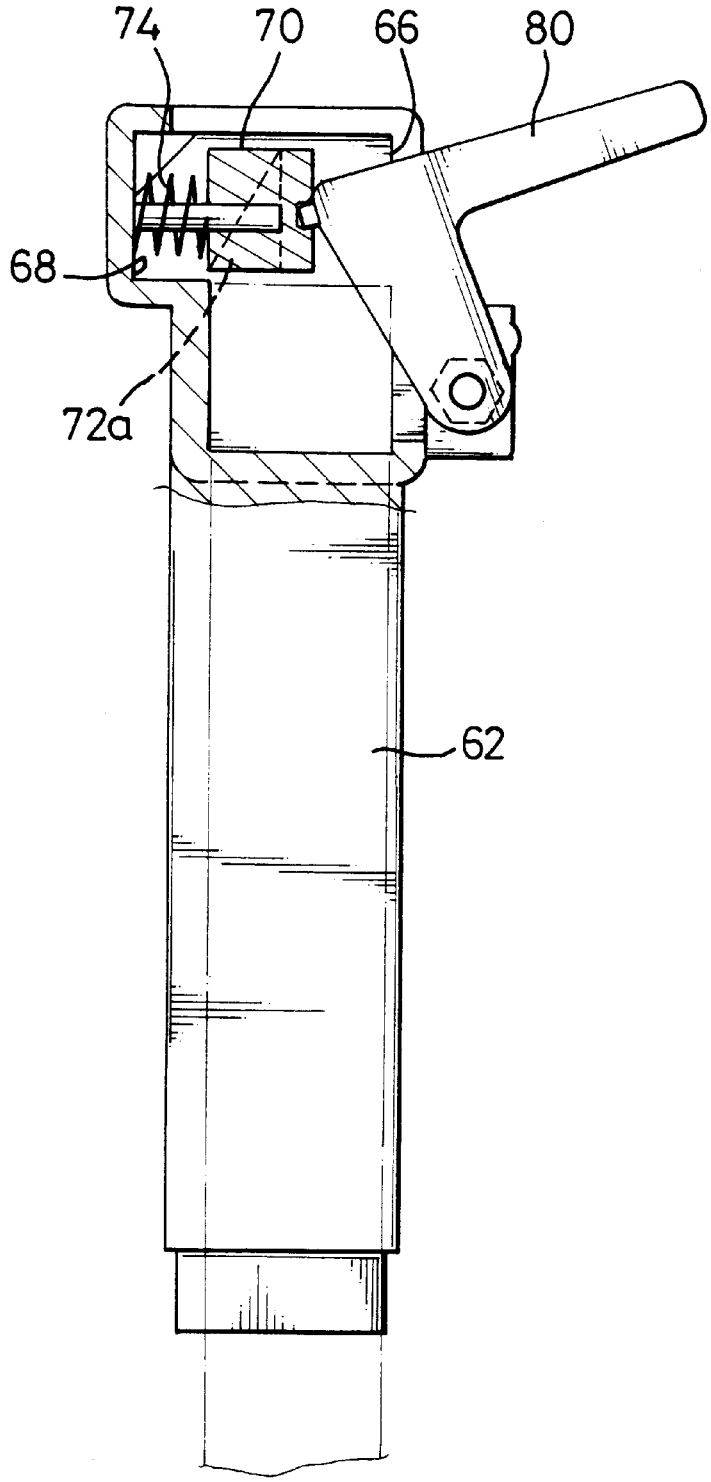
FIG. 8. shows a side view of the auxiliary coupling holder, which is under such a second condition that a bottom side-bar of the invention can be freely pivoted with respect thereto.

Referring to FIGS. 6, 7 and 8, the first auxiliarity coupling holder 60 includes a T-shaped body 62 defining a space 64 defined therein, a transverse bolt 70, and a L-shaped lever 80 (the second auxiliary coupling holder 60' has the same structure as the first auxiliary coupling holder 60, thus description therefor is omitted here). The space 64 is partially defined by a first inner surface 66 and a second inner surface 68 (opposite to the first inner surface 66) of the T-shaped body 62. The transverse bolt 70, which is substantially an elongate rectangular body, is disposed in the space 64 of the T-shaped body 62 to be normally rested on the first inner surface 66 of the T-shaped body 62 by means of a spring 74. The transverse bolt 70 has a first bevel surface 72*a* formed on a left corner thereof (when viewed as in FIG. 6) which is located near the first inner surface 66 and has a second bevel surface 72*b* formed on a right corner thereof which is located near the first inner surface 66. In this normal condition, since the ends of the first bottom side-bar 22 and the second bottom side-bar 24 associated with the first auxiliarity coupling holder 60 cannot freely extend past the transverse bolt 70, the first bottom side-bar 22 and the second bottom side-bar 24 can be securely coupled as an integral straight section of bar to guarantee the structural rigidity of the invention. Similarly, the third bottom side-bar 26 and the fourth bottom side-bar 28 can be securely coupled as an integral straight section of bar in the same manner by the second auxiliary coupling holder 60' to guarantee the structural rigidity of the invention. (see FIGS. 1–3).

Referring again to FIGS. 6, 7 and 8, the L-shaped lever 80, being functioned as an actuator, is disposed for pressing the transverse bolt 70 to move from the first inner surface 66 toward the second inner surface 68 of the T-shaped body 62, to thereby have the bevel surfaces 72*a* and 72*b* moved away from the first surface 66 of the T-shaped body 62 to approach the second surface 68 of the T-shaped body 62. In such a condition, since the ends of the bottom side-bars 22, 24 can extend past the transverse bolt 70 respectively along the first bevel surface 72*a* and the second bevel surface 72*b* thereof, the first bottom side-bar 22 and the second bottom side-bar 24 can be pityingly folded with respect to the first auxiliary coupling holder 60. Similarly, the third bottom side-bar 26 and the fourth bottom side-bar 28 can be pivotingly folded with respect to the second auxiliary coupling holder 60' (see also FIG. 14) by turning the L-shaped lever 80 upwards.

Referring again to FIGS. 6–8, the L-shaped lever 80 is rotatably mounted on the T-shaped body 62 to be engagable with the transverse bolt 70. The L-shaped lever 80 is provided with a boss 82 while the transverse bolt 70 defines a recessed hole 74 which is capable of receiving the boss 82. When the L-shaped lever 80 is turned upwards, the L-shaped lever 80 is held in a fixed place. In such a condition, the transverse bolt 70 has been moved from the first inner surface 66 to the second inner surface 68 so that the first, second, third and fourth bottom side-bars 22, 24, 26, 28 can be folded.

In operation, referring to FIGS. 1 and 8, when the present invention is to be used, the bottom side-bars 22, 24, 26, 28 and the diagonal bars 44 thereof can be pivoted outwards and downwards while the four top articulated bars 6 thereof can be pivoted outwards and downwards to extend the frame 2 of the invention from the original folding state of the present invention (see FIG. 8). When the present invention is not in use, upon actuating the L-shaped lever 80 of the T-shaped body 62, the bottom side-bars 22, 24, 26, 28 and the diagonal bars 44 thereof can be pivoted inwards and downwards while the four top articulated bars 6 can be pivoted inwards and upwards to fold the present invention from the extending state of the present invention (see FIG. 1).

Figure 10:
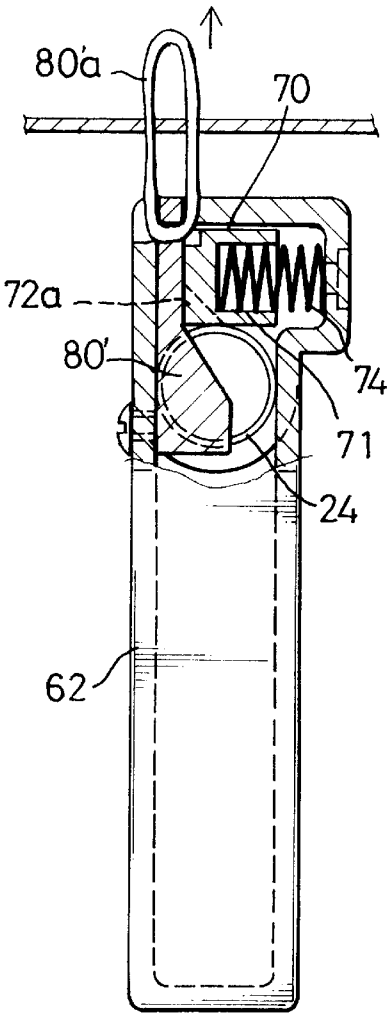
FIG. 10 is a side view partly in section of the modified auxiliary coupling holder, which is under such a normal condition such that a bottom side-bar of the invention cannot be pivoted with respect thereto.
Figure 9:
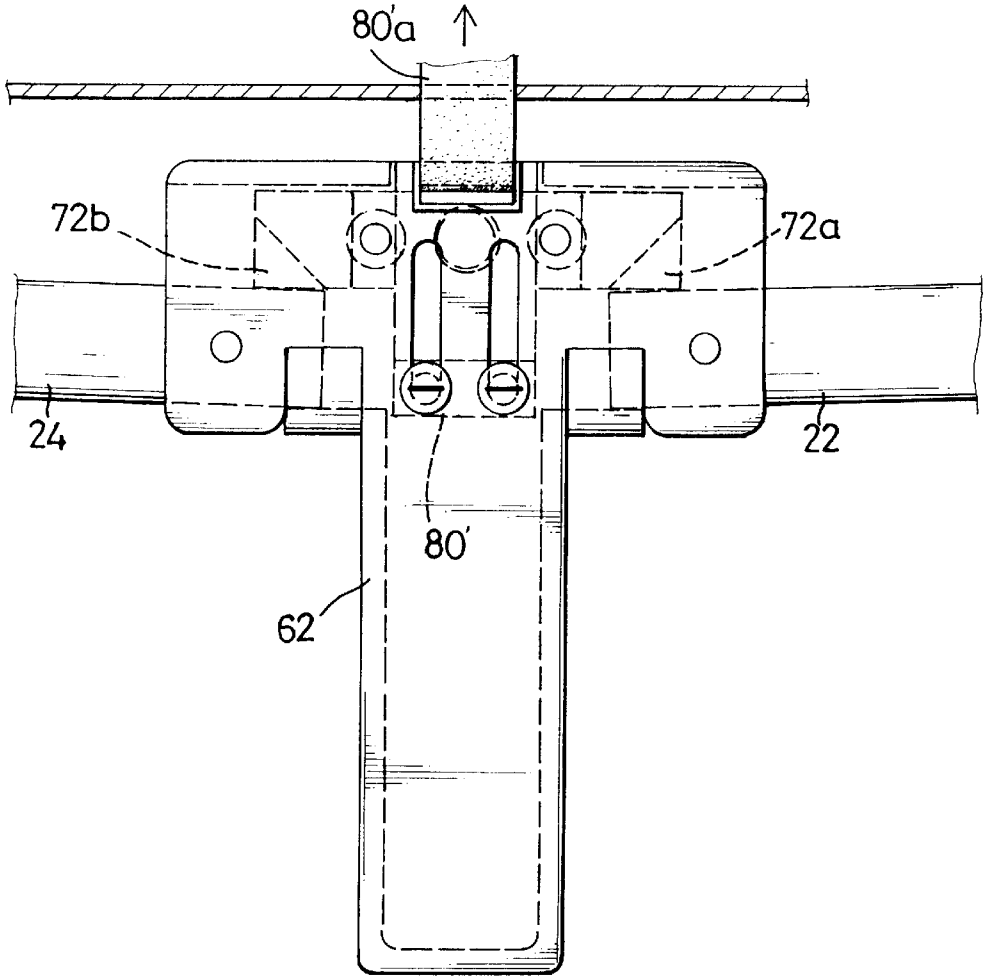
FIG. 9 is a front view of a modified auxiliary coupling holder disclosed in the present invention.
Figure 11:
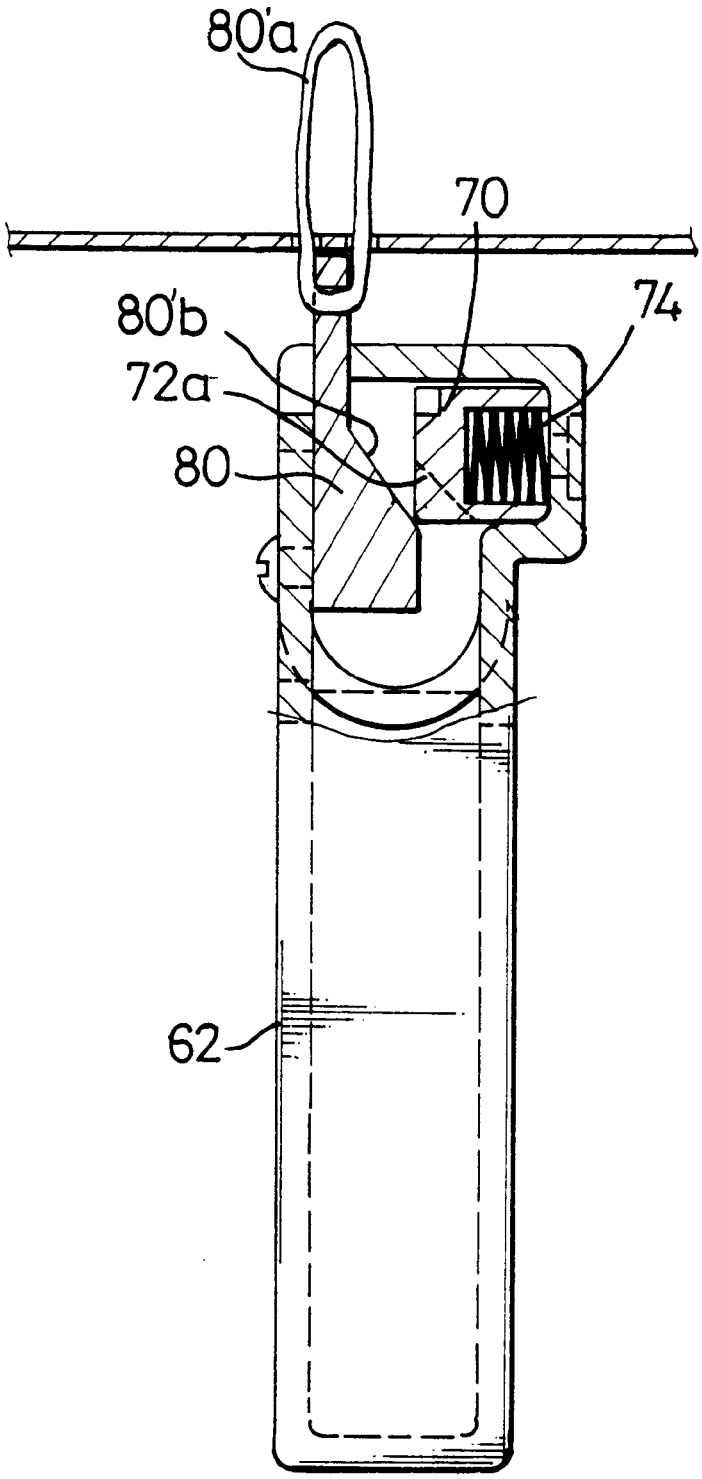
FIG. 11 is a side view partly in section of the modified auxiliarity coupling, which is under such a second condition that a bottom side-bar thereof can be freely pivoted with respect thereto.

Further, the L-shaped lever 80, functioning as an actuator, may be modified to be as a sliding block 80' as shown in FIGS. 9–11. The sliding block 80' is attached with a loop 80'*a* which extends above the T-shaped body 62. The sliding block 80' has a sloping surface 80'*b* formed thereon for being slidingly in contact with the transverse bolt 70. The sliding block 80' has a greater dimension at its bottom than at its top. Therefore, when the sliding block 80' is moved upwards by pulling the loop 80'*a* (see FIG. 11), the transverse blot 70 can be pressed by the sloping surface 80'*b* of the sliding block 80' so that the bevel surfaces 72*a* and 72*b* can be moved away from the first inner surface 66 to approach the second inner surface 68, so that the first, second, third and fourth bottom side-bars 22, 24, 26, 28 can be folded in the same manner as set forth above.

Figure 12:
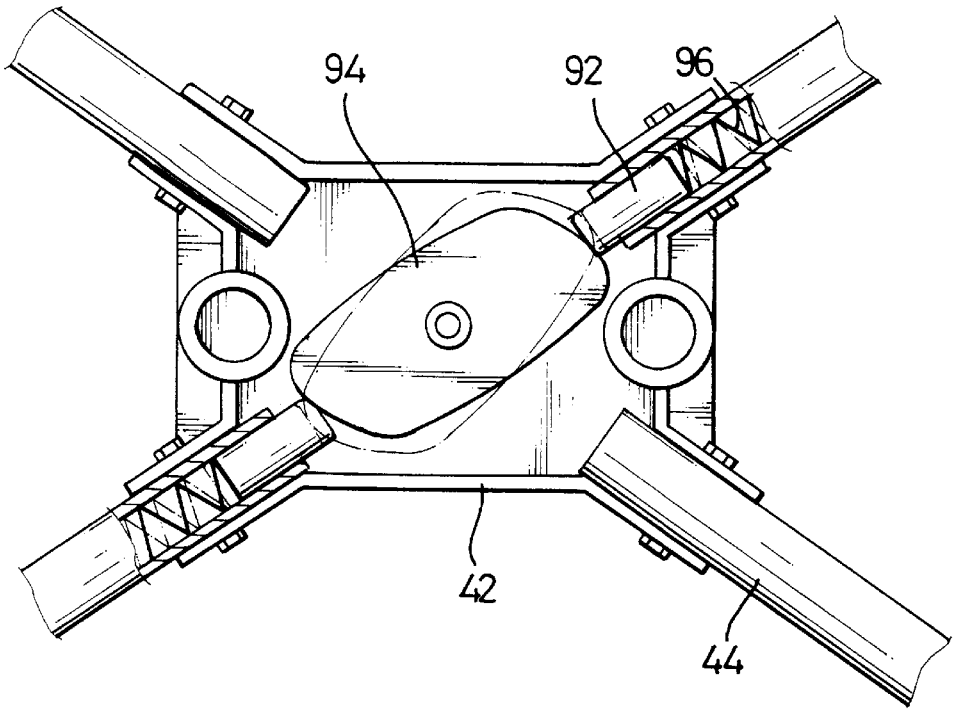
FIG. 12 shows a retaining device disclosed in the present invention, which is mounted on a folding head also disclosed in the present invention.
Figure 13:
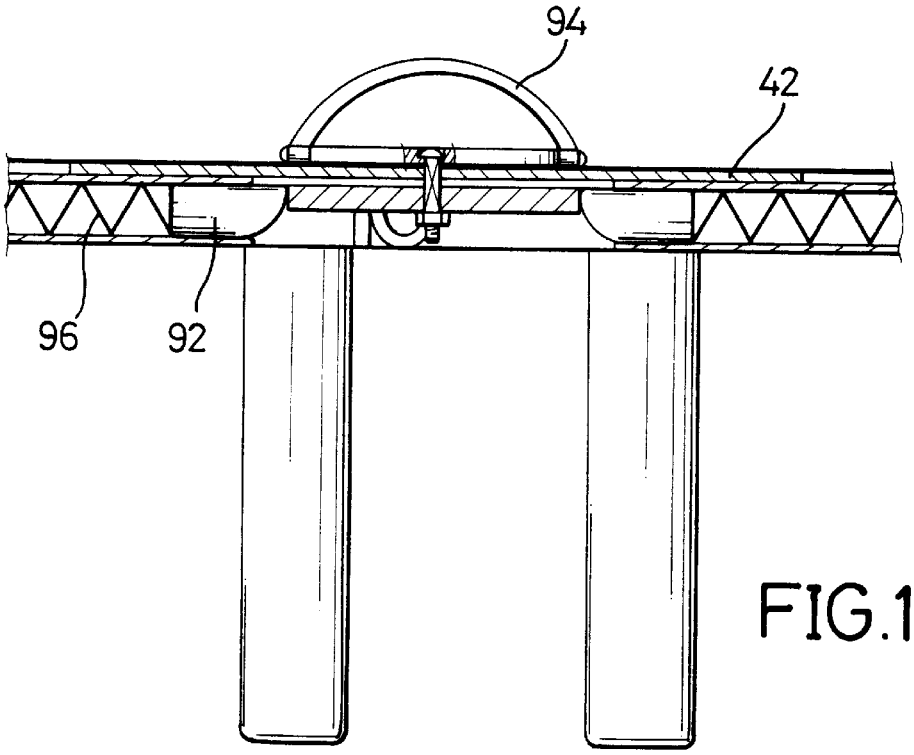
FIG. 13 shows a cross-sectional side view of the retaining device disclosed in the present invention.

Still further, as shown in FIGS. 12 and 13, the folding head 42 of the folding mechanism 40 can be provided with a retaining device 90 for rendering at least one of the diagonal bars 44 in an extended and non-pivotable condition so that, when the present invention is in use, the structural rigidity of the sub-frame structure 8 can be strengthened. As shown in FIGS. 12 and 13, the retaining device 90 includes at least one button 92 and a cam 94. The button 92 is resiliently mounted in one of the diagonal bars 44 with a spring 96 (although the figures show two buttons mounted in two diagonal bars). The button 92 is so mounted to normally and partially protrude from the associated diagonal bar 44. The cam 94 is mounted on an undersurface of the folding head 40 and attached with a knob 94*a*. The cam 94 has a profile to be configured such that when the cam 94 is rotated a predetermined angle by the knob 94*a* to a position (at which the dotted line is depicted), the button 92 can be pressed into the first end 44*a* of the associated diagonal bar to render the associated diagonal bar pivotable with respect to the folding head 42, simultaneously with the pivoting of the bottom side-bars 22, 24, 26 and 28 so that the present invention can be folded into a compact package.

Referring back to FIG. 1, the present invention can be provided with a wooden floorboard 100 placed in the enclosure of the present invention on top of the bottom sub-frame structure 8 of the present invention for making a supporting floor for a baby. Further, in order that the wooden floorboard 100 can be completely supported by the bottom sub-frame structure 8, the end portion of each bottom side-bar 22, 24, 26 and 28 which connects with the diagonal bars can be curved somewhat inwardly of the folding head 42 (see FIGS. 2 and 3) to effectively hold the wooden floorboard 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foldable playpen comprising a main frame constructed of top articulated bars and upright bars, said main frame being provided with a covering to form an enclosure within which a baby can be left to play, said main frame including a bottom sub-frame structure which has a center and includes:

at least first, second, third and fourth bottom side-bars, said first bottom side-bar being disposed in alignment with said second bottom side-bar, said third bottom side-bar being disposed in alignment with said fourth bottom side-bar, each of said first, second, third and fourth bottom side-bars having one end arranged to be pivotally connected with one of said upright bars of said main frame respectively, each of said first bottom side-bar and said second bottom side-bar having another end arranged to be controllably and pivotably connected with a first auxiliary coupling holder so that said first bottom side-bar can be coupled with said second bottom side=bar to form an integral straight section of bar, each of said third bottom side-bar and said fourth bottom side-bar having another end arranged to be controllably and pivotably connected with a second auxiliary coupling holder so that said third bottom side-bar can be coupled with said fourth bottom side-bar, and each of said first auxiliary coupling holder and second auxiliary coupling holder including:

a T-shaped body defining a space therein, said space being partially defined by a first inner surface and a second inner surface of said T-shaped body;

a transverse bolt having an elongate rectangular body received in said space of said T-shaped body, said rectangular body being caused by a spring to normally rest on said first inner surface of said T-shaped body, said transverse bolt having a first bevel surface formed on a first distal corner thereof which is located near said first inner surface and having a second bevel surface formed on a second distal corner thereof which is located near said first inner surface; and means for pressing said transverse bolt to cause it to move from said first inner surface toward said second inner surface of said T-shaped body, thereby moving said first and second bevel surfaces of said transverse bolt from said first surface so that the first and second bevel surfaces approach said second surface of said T-shaped body, thereby permitting said first bottom side-bar and said second bottom side-bar to pass said transverse bolt respectively along said first and second bevel surfaces thereof and cause said first and second bottom side-bars to pivot with respect to said first auxiliary coupling holder, said third bottom side-bar and said fourth bottom side-bar also being permitted to pass said transverse bolt respectively along said first and second bevel surfaces thereof and cause said third and fourth bottom side-bars to pivot with respect to said second auxiliary coupling holder; and a folding mechanism including a folding head located substantially at the center of said bottom sub-frame structure of said main frame, and a plurality of diagonal bars which are arranged to surround said folding head to be each pivotable connected with said folding head at one end thereof and to be each pivotably connected with one of said first, second, third and fourth bottom side-bars at another end thereof by means of a hinge member, said hinge member having a sleeve portion which is movable and rotatably mounted with a corresponding one of said first, second, third and fourth bottom side-bars so that said diagonal bars can be rotated and moved with respect to each bottom side-bar associate therewith to allow said diagonal bars to be pivoted with respect to said folding head, in cooperation with a folding of said first, second, third and fourth bottom side-bars together with a folding of said top articulate bars, so as to fold said playpen.

2. A foldable playpen as claimed in claim 1, wherein said pressing means is an L-shaped lever rotatably mounted on said T-shaped body to be engagable with said transverse bolt, said L-shaped lever having a boss formed thereon while said transverse bolt defining a recessed hole which is capable of receiving said boss, when rotating said transverse bolt upwards, to allow said L-shaped lever to be held in a fixed place and to allow said transverse bolt to move from said first inner surface of said T-shaped body towards said inner surface of said T-shaped body, so as to fold said foldable playpen.

3. A foldable playpen as claimed in claim 1, wherein said pressing means is a sliding block, attached with a loop which is disposed to extend above said T-shaped body, said sliding block having a sloping surface formed therein for being slidingly in contact with said transverse bolt, said sliding block having a greater dimension at its bottom than at its top so that when said sliding block is moved upwards by pulling said loop, said transverse bolt can be pressed by said sliding block to move from said first inner surface of said T-shaped body to said second inner surface of said T-shaped body so as to fold said foldable playpen.

4. A foldable playpen as claimed in claim 1, wherein said folding head is provided with a device for rendering at least one of said diagonal bars in an extended and non-pivotable condition so that, when said foldable playpen is in use, the structural rigidity of said bottom sub-frame structure can be strengthened, wherein said retaining device includes:

at least one button resiliently mounted in one of said diagonal bars with a spring, said button being so mounted to normally and partially protrude from the associated diagonal bar;

a cam mounted on an undersurface of said folding head, said cam having a profile to be configured such that when said cam is rotated a predetermined angle, said button can be pressed into the associated diagonal bar to render the associated diagonal bar pivotable with respect to said folding head so that said foldable playpen can be folded.

5. A foldable playpen as claimed in claim 1, further comprising a wooden floorboard placed in said enclosure on top of said bottom sub-frame structure.

6. A foldable playpen as claimed in claim 5, wherein each said bottom side-bar is curved inwardly of said folding head to effectively support said wooden floorboard.

* * * * *